United States Patent [19]

Brand et al.

[11] Patent Number: 4,516,952

[45] Date of Patent: May 14, 1985

[54] PUSH-DOWN ACTUATED TOY

[75] Inventors: Derek A. Brand, Camarillo; Derek R. Brand, Carpinteria; Kenneth J. Brand, Camarillo, all of Calif.

[73] Assignee: Derek and Derek, Ventura, Calif.

[21] Appl. No.: 371,494

[22] Filed: Apr. 22, 1982

[51] Int. Cl.[3] ..... A63H 17/14

[52] U.S. Cl. ..... 446/427; 446/448; 446/466

[58] Field of Search ..... 46/201, 202, 40, 39, 46/221, 222, 206; 446/448, 449, 431, 465, 466, 469, 470, 432, 434, 424, 425, 426, 427, 428

[56] References Cited

U.S. PATENT DOCUMENTS 2,012,343 8/1935 Goriup ..... 46/206

3,144,731 8/1964 Jones et al. ..... 446/466

FOREIGN PATENT DOCUMENTS 945178 12/1963 United Kingdom ..... 46/221

*Primary Examiner*—Mickey Yu

*Attorney, Agent, or Firm*—Harry W. Brelsford

[57] ABSTRACT

Toy vehicles having a rigid body supported by wheel assemblies for movement on a support surface. A spring element is positioned between the vehicle body and the wheel assemblies for biasing the vehicle body in a normally raised position with respect to the wheel assemblies. A movable member is mounted on the body and is in contact with the wheel assembly and/or the spring element. The movable member is activated by the wheel assembly and/or the spring element as the vehicle body is lowered by a user and raised by the spring bias.

3 Claims, 16 Drawing Figures

PUSH-DOWN ACTUATED TOY

TECHNICAL FIELD

This invention relates to toy vehicles that are manually grasped to move them about a play surface and has particular reference to such toy vehicles that carry a part that can be actuated by manually pressing down on the vehicle. The actuated part simulates real life movable parts such as the blade on a bulldozer, the forklifts on a forklift truck, the dump body on a dump truck and a movable hook and boom on a crane truck

BACKGROUND OF THE PRIOR ART

Toy vehicles have been made with actuated parts but generally these parts are moved by a separate finger push button, crank, electric motor, etc. Such toys tend to be complicated mechanically and are therefore more expensive to manufacture. There has existed a need for vehicles with actuated parts that can be simply operated and preferably by the same manual grasp that moves the toy about a play surface.

BRIEF SUMMARY OF THE INVENTION

We have discovered that we can actuate a vehicle part quite simply by providing vertical motion between the wheels and axles as one part, and the vehicle body as another part. We provide a spring to normally keep the vehicle body elevated with respect to the wheel axle, or more broadly, elevated with respect to the play surface. When a child or other user manually grasps the toy vehicles to move them about the play surface he presses our vehicles downwardly, overcoming the spring. The downward movement is utilized by us to actuate the part; i.e., the bulldozer blade is lowered, the skip bucket is lowered, the dump body is restored to a horizontal position, etc. The structure that causes this operation may be by movement of wheel axles relative to the vehicle body, movement of the spring as the vehicle body is pressed downwardly, or various other structures.

BRIEF DESCRIPTION OF THE DRAWINGS

Various objects, advantages and features of the invention will be apparent in the following description and claims considered together with the drawings forming an integral part of this specification and in which:

DETAILED DESCRIPTION OF THE INVENTION

Figure 1:
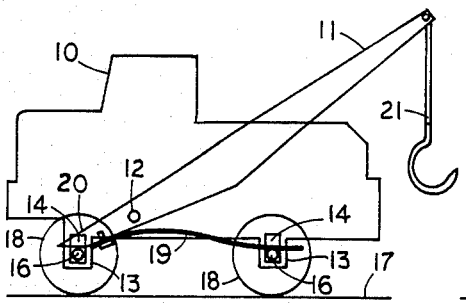
FIG. 1 is an elevation view of a toy tow truck wherein the body of the truck is elevated with respect to the wheels and a crane boom is in elevated position.

Referring to FIG. 1 there is illustrated in diagrammatic form a tow truck body 10 having a crane boom 11 pivoted thereto at 12 and having downwardly depending axle hangers 13 having a generally vertical slot 14 within which wheel axles 16 may move vertically with respect to the body 10. The entire toy is supported on a play surface 17 and wheels 18 are connected to the axles 16 to thereby support the vehicle.

Provided particularly in accordance with the invention is a bent leaf spring 19 pinned or otherwise secured to the boom 11 to the left of its pivot point 12. It will noted that a lower left end tip 20 of the boom 11 rests against the front axle 16 of the truck body 10. The leaf spring 19 has its other end bearing against the rear axle 16 and this holds the boom 11 in the elevated position illustrated in FIG. 1.

Figure 1A:
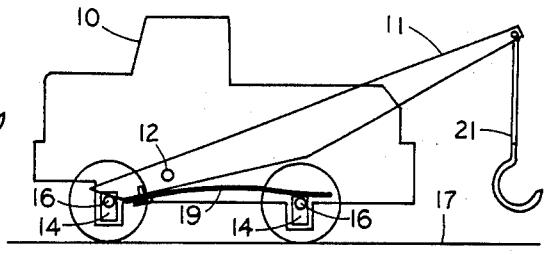
FIG. 1A is an elevation view of the truck FIG. 1, wherein the truck body has been moved downwardly with respect to the wheels and wheel axles and this has caused the boom to be rotated clockwise so that the hook can be placed under another vehicle or other object to be lifted by the hook at the end of the boom.

Illustrated in FIG. 1A is the position of the wheel axles 16 when the vehicle has been manually grasped and shoved downwardly on the play surface 17. In this case the boom 11 has been rotated round its pivot 12 to a point where a hook 21 on the end of the boom 11 is lowered so that it can engage any particular vehicle or other item desired to be lifted by the assembly. The child or other person operating the toy then maneuvers the vehicle until the hook 21 is under a desired object whereupon the user relaxes his downward push on the vehicle and the leaf spring 19 causes the vehicle body to lift upwardly and the spring pressing directly on the boom 11 causes it to rotate counterclockwise to the elevated position shown in FIG. 1 lifting any object that is engaged by the hook 21.

Figure 2:
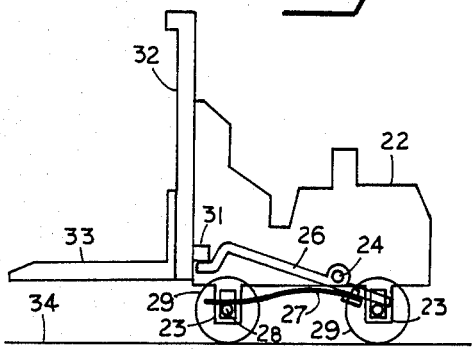
FIG. 2 is an elevation view of a toy forklift wherein the forks are in an elevated position.

Referring to FIG. 2 there is illustrated a forklift body 22 having downwardly extending axle hangers 23 similar to the axle hangers of FIG. 1. Pivoted to the body 22 at 24 is an actuating lever 26 which is held in its position illustrated by leaf spring 27, the forward end of which bears on axle 28 for a pair of front wheels 29. The left end of the pivoted actuator 26 engages a rearwardly a projecting lug 31 on the rear surface of a vertically movable guide 32 for a pair of forks 33. The clockwise rotation of the actuator lever 26 is stopped by the rear axle 28 of the rear wheels 29. In this case the actuated part is the pair of forks 33 which are guided in their vertical movement by the vertical guide 32.

Figure 2A:
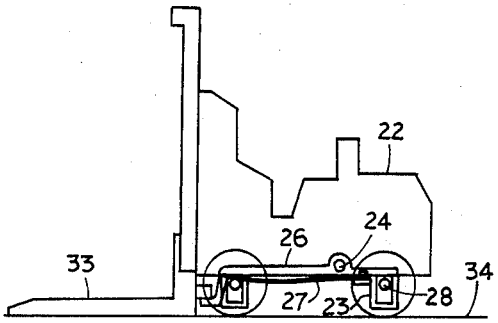
FIG. 2A is an elevation view of the same forklift of FIG. 2 wherein the vehicle body has been pressed downwardly on the wheels to flex the elevating spring and thereby causing the forks to drop to ground level or the level of the play surface.

Illustrated in FIG. 2A is the forklift of FIG. 2 wherein the forklift body 22 has been manually moved downwardly toward a play surface 34 causing the axles 28 to move upwardly in their axle hangers 23. The rear axle 28 bearing against the end of the actuator lever 26 causes that lever to rotate counterclockwise about its pivot 24 and this permits gravity to lower the forks 33 until they rest on the play surface 34.

Figure 3:
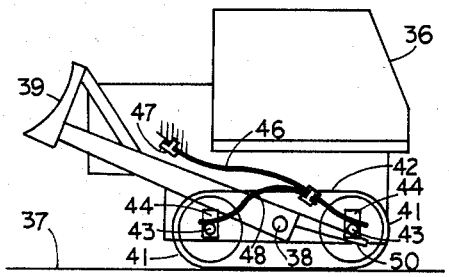
FIG. 3 is an elevation view of a toy bulldozer wherein the bulldozer blade is in an elevated position.

Referring to FIG. 3 there is illustrated a bulldozer body 36 supported on a play surface 37 and pivoted to the body at 38 is a bulldozer blade 39. The body 36 is supported on the surface 37 by means of a pair of sprocket wheels 41 having a tread 42 passing around them and the wheels have axles 43 which ride in axle slots 44 formed in the bulldozer body 36.

Provided particularly in accordance with the invention is a bifurcated spring having one fork 46 secured to the body 36 at 47, and having another fork 48 connected to the first leaf spring. The rear end of 46 rests upon the rear axle 43. The front end of branch leaf spring 48 rests on the front axle 43. Projecting to the rear of the pivot 38 is a rearward extension 50 of the boom on which the bulldozer blade 39 is mounted. It is this bearing of the boom portion 50 against the rear axle 43 that maintains the bulldozer blade 39 in an elevated position.

Figure 3A:
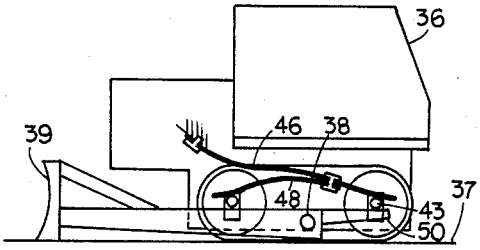
FIG. 3A is an elevation view of the same bulldozer of FIG. 3 wherein the bulldozer body has been pressed downwardly with respect to the wheels and wheel axles and this causes the bulldozer blade to drop downwardly while the body is so depressed.

Illustrated in FIG. 3A is the bulldozer of FIG. 3 after the vehicle body has been pushed downwardly on the play surface 37. There it will be noted that the rear axle 43 is now in an elevated position with respect to the vehicle body 36 whereupon gravity permits the bulldozer blade 39 to rotate about its axis 38 until the blade assumes a position on the play surface 37. Thereafter the child or other user of toy may push dirt or other objects ahead of the bulldozer by maintaining this downward pressure on the vehicle body 36 which overcomes the action of the springs 46 and 48. When the desired amount of material has been moved by the bulldozer blade 39 the user relaxes the downward push on the body 36 and the blade thereupon rises to the position shown in FIG. 3.

Figure 4:
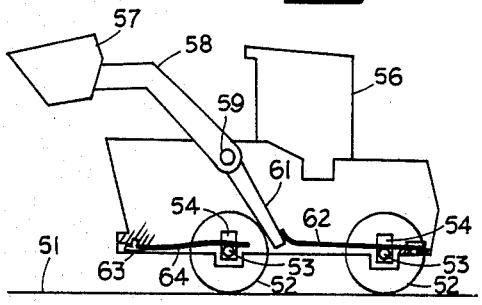
FIG. 4 is an elevation view of a skip loader wherein the skip bucket is in an elevated position.

Referring to FIG. 4, supported on a play surface 51 are two pairs of wheels 52, each pair having an axle 53 riding vertically in a slot 54 formed in a vehicle body 56. Disposed on each side of the vehicle body 56 is a pair of bucket arms 58 pivoted at 59 to support a skip loader bucket 57. Extending downwardly from the pivot 59 is a lower extension 61 of the side arms 58 and a cantilever leaf spring 62 bears against the lower end of this arm extension 61 to hold the bucket 57 in an upright position. This same cantilever spring 62 engages the rear axle 53 to hold the rear end of the vehicle body 56 in an upward position with respect to the wheels. Secured to the front end of the vehicle body 56 at 63 is a forward cantilevered spring 64 which bears on the front axle 53 to keep the forward end of the body in an elevated position.

Figure 4A:
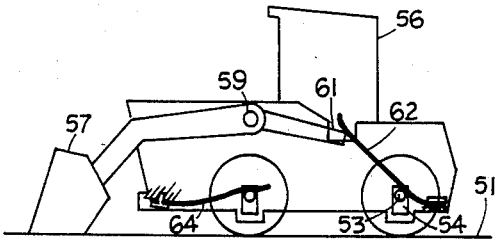
FIG. 4A is an elevation view of the skip loader of FIG. 4 wherein the vehicle body has been pressed downwardly with respect to the wheel axles causing the skip loader bucket to drop to the ground or play surface.

Referring to FIG. 4A, there is illustrated the vehicle FIG. 4 in a position where downward manual pressure has been applied to move the axles 53 to the top of the slots 54. This upward movement of the rear axle 53 deflects the rear spring 62 in a clockwise direction so that it releases its pressure upon the arm extension 61 allowing gravity to take over and move the skip bucket 57 to the play surface 51. The same downward manual force causes the forward spring 64 to deflect also. The skip bucket is loaded by the child or other person using the toy and when full the manual downward pressure is released and the springs thereupon cause the vehicle body 56 to rise as shown in FIG. 4. The toy is then manually moved to the desired location whereupon the downward pressure on the vehicle again causes the skip loader bucket to dump its load of material.

Figure 5:
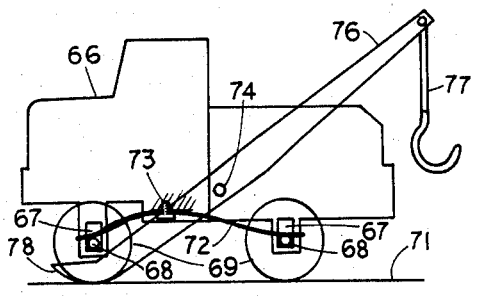
FIG. 5 is an elevation view of a crane truck with the crane boom in an elevated position.

Referring to FIG. 5 there is illustrated a crane truck body 66 having vertical axle slots 67 in which are disposed axles 68 mounted on wheels 69 which ride on a play surface 71. Pinned or otherwise secured to the body at 73 is a leaf spring 72 which bears against both the front and rear axles 68 to hold the vehicle body 66 in an elevated position. Pivoted to the body 66 at 74 is a crane boom 76 having a pivoted hook 77 on the upper end and a lower end 78 rides on the play surface 71.

Figure 5A:
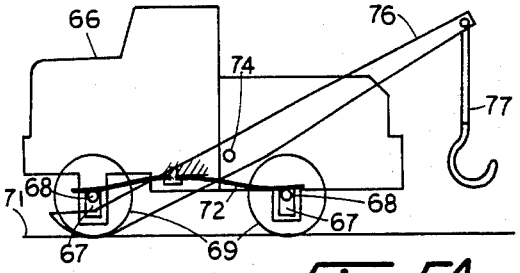
FIG. 5A is an elevation view of the crane truck of FIG. 5 wherein the vehicle body has been pressed downwardly with respect to the wheels and this causes a clockwise motion of the crane boom to lower the hook on the end thereof.

Illustrated in FIG. 5A is the vehicle FIG. 5 wherein manual downward pressure has forced the axles 68 to the top of their slots 67. This lowering of the vehicle body 66 causes the boom 76 to rotate about its pivot 74 until the hook is in a lower position where it may engage a vehicle or any other device to be lifted when the downward pressure is removed.

Figure 6:
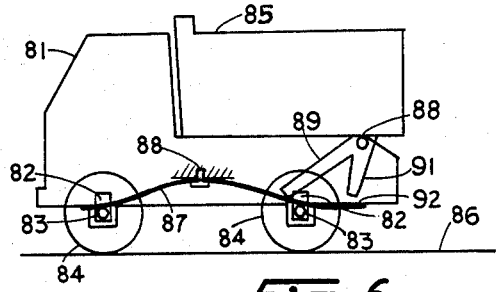
FIG. 6 is an elevation view of a dump truck that normally has the dump body in a horizontal position.

Illustrated in FIG. 6 is a dump truck body 81 having vertical axle slots 82 in which ride axles 83 attached to wheels 84 riding on a play surface 86. A single leaf spring 87 is pinned or otherwise secured to the body at 88 and the spring has a forward bearing on the front axle 83 and has a bearing on the rear axle 83 to hold the dump truck body 81 in an elevated position. Disposed on the dump truck frame 81 is a dump body 85 pivoted to the frame at 88. Diagonally forwarding projecting arm 89 is secured to the bottom of the dump body 85 and a more vertically downwardly depending arm 91 is also secured to the dump body 85. Provided particularly in accordance with the invention is a rearward extension 92 of the spring 87.

Figure 6A:
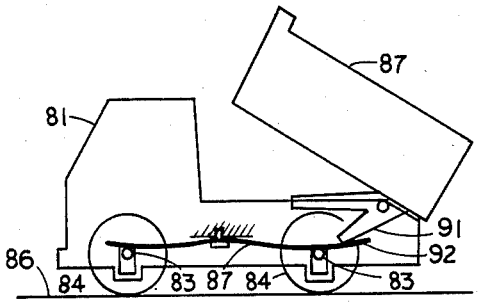
FIG. 6A is an elevation view of the dump truck of FIG. 6 wherein the drump truck body has been pushed downwardly with respect to the wheels causing the dump body to rotate clockwise to discharge its contents by gravity flow.

Illustrated in FIG. 6A is the vehicle of FIG. 6 wherein the dump truck frame 81 has been pushed downwardly and the rear axle 83 causes a counterclockwise deflection of the rear end of spring 87 and its rearward extension 92. This rearward extension 92 is forced upwardly against the arm 91 on the bottom of the dump body 85 causing that dump body to rotate clockwise as illustrated in FIG. 6A. The contents of the dump body 85 thereupon slide by gravity out of the dump body 85 and the child or other operator of the toy then releases the manual downward pressure to the point where the springs 87 and 92 assume the position shown in FIG. 6 and the dump body 85 rotates by gravity to the position shown in FIG. 6.

Figure 7:
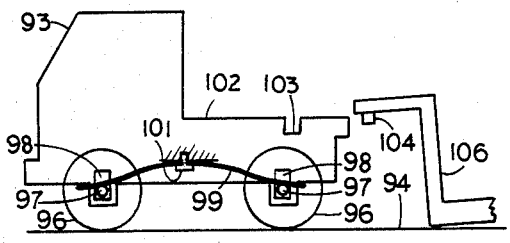
FIG. 7 is an elevation view of a toy tractor truck with a rear connecting portion at too high an elevation to fit underneath a trailer tongue.

Referring to FIG. 7 there is illustrated in diagramatic form a toy truck tractor 93 supported on a play surface 94 by a pair of wheels 96 mounted on axles 97 which move vertically in slots 98 formed in the body 93. The vehicle body 93 is urged upwardly from the play surface 94 by leaf spring 99 pinned or otherwise secured to the truck body at 101 and the ends of the spring 99 bear against the axles 97 to hold the truck body 93 in an elevated position. The upper rear part of the tractor 93 is formed in a flat towing surface 102 having a kingpin recess 103 formed therein. The flat surface 102 is at too high an elevation in FIG. 7 to fit underneath a trailer tongue 106 having a downwardly projecting kingpin 104.

Figure 7A:
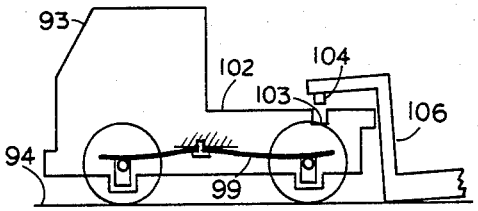
FIG. 7A is an elevation view of the toy truck tractor of FIG. 7 wherein the body has been pushed manually downwardly on the wheels to thereby cause it to fit underneath the tongue of the trailer so that the toy tractor can thereupon be released to rise up and engage the trailer tongue.

Illustrated in FIG. 7A is the toy truck tractor 93 after it has been pushed manually downward and moved towards the trailer hitch 106. This downward movement causes the towing surface 102 to be below the lower end of the kingpin 104 and the kingpin recess is now located directly beneath the kingpin 104. Relaxation of the downward manual pressure on the vehicle body 93 will allow the spring 99 to move the body upwardly thereby engaging the kingpin 104 in the kingpin recess 103. Thereafter the tractor 93 may be moved manually as desired pulling the tractor behind it of which the trailer hitch 106 is a forward part.

Figure 8:
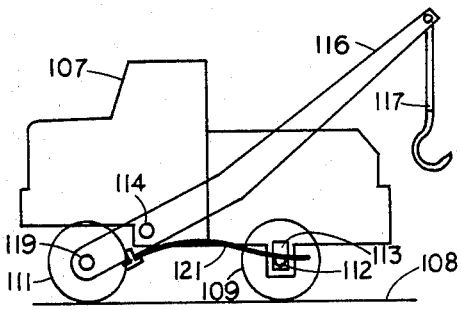
FIG. 8 is an elevation view of a crane truck wherein the front axle is directly mounted on one end of the crane boom.

Illustrated in FIG. 8 is a tow truck body 107 supported on a play surface 108 by a pair of rear wheels 109 and a pair of forward wheels 111. The rear wheels 109 are mounted on an axle 112 vertically movable in a slot 113 in a axle hanger formed on the body. Pivoted to the body 107 at 114 is a crane boom 116 having a downwardly depending hook 117 on its outer end. The lower end of the boom 116 has an axle 119 passing through it supporting the front wheels 111. Pinned or otherwise secured to the boom 116 is a leaf spring 121 which bears against the rear axle 112 to urge the boom 116 in a normal counterclockwise direction.

Figure 8A:
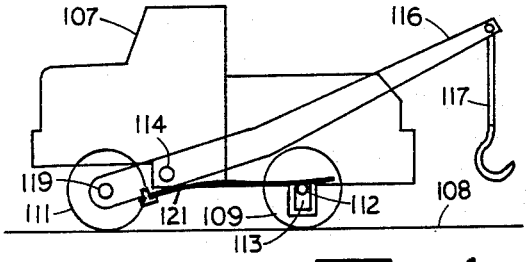
FIG. 8A is an elevation view of the crane truck of FIG. 8 after the vehicle body has been pushed downwardly with respect to the play surface or the wheel axles causing a clockwise movement of the truck boom.

Illustrated in FIG. 8A is the vehicle of FIG. 8 after it has been manually pushed downwardly. There it will be noted that the boom 106 has rotated clockwise to lower the hook 117 to a position where it can be inserted underneath another vehicle or other object for lifting and towing. The rear wheels 109 have moved upwardly with respect to the vehicle body 107 by virtue of their axle 112 being at the top of the slot 113. The front wheels 111 also have moved upwardly with respect to the body 107 by the action of the boom 116 rotating about its pivot 114. When the downward manual pressure on the vehicle is relaxed then the spring 121 will cause the vehicle to rise with respect to its play surface 108 and will cause the boom 116 to rotate to the position illustrated in FIG. 8 whereupon the device may be towed away by the vehicle 107.

STATEMENT OF INDUSTRIAL APPLICATION

The toy vehicles of this specification are manually operated by manually pushing them in a horizontal direction and the actuated part is energized or actuated by manually pressing downwardly on the vehicle to overcome the springs that keep the vehicle body in an elevated position with respect to the play surface. This simple type of actuation of a part makes the device extremely rugged and reliable, and inexpensive to manufacture.

It will be apparent that the strength of the springs that keep the vehicle in an elevated position should be such that they can be easily overcome by a child or other person using the toy by merely pressing downwardly on the toy. The spring should be strong enough however in addition to holding the vehicle body upwardly so that the tow truck for example can carry a load in addition to the weight of the vehicle body. Most of the embodiments illustrated have employed wheels and axles as the means for supporting the vehicle body with respect to a play surface. However other types of supports can be used such as the tractor treads of FIG. 3 and FIG. 3A. We prefer to have our springs and some of the actuation be accomplished by bearing against the axles of the wheels and accordingly in this context the wheels and axles operate as a single movable unit on the vehicles.

We have described our invention with respect to our presently preferred embodiments as required by the patent statutes. We include within the scope of the following claims all modifications and variations that come within the true spirit and scope of our invention.

We claim:

1. A toy vehicle supported on a play surface and having actuation of a part comprising:

(a) a rigid vehicle body;

(b) means for supporting the vehicle with respect to the play surface and allowing generally vertical movement between the vehicle body and said means for supporting the vehicle body;

(c) resilient means exerting a force between the support means and the vehicle body to hold the vehicle body upwardly with respect to the vehicle support means and having a strength that is overcome by manually pushing the vehicle body toward the play surface;

(d) an actuated part mounted on the vehicle body and moveable through a normal range and having a physical engagement with said means for supporting the vehicle, whereby manually pressing the rigid vehicle body causes the means for supporting the vehicle to move with respect to the vehicle and simultaneously move the actuated part because of its engagement with the means for supporting the vehicle.

2. A toy vehicle supported on a play surface and having actuation of a part comprising:

(a) a vehicle body;

(b) means for supporting the vehicle with respect to the play surface and allowing generally vertical movement between the vehicle body and said means for supporting the vehicle body;

(c) resilient means exerting a force between the support means and the vehicle body to hold the vehicle body upwardly with respect to the vehicle support means and having a strength that is overcome by manually pushing the vehicle body toward the play surface;

(d) and an actuated boom part mounted on the vehicle body and movable through a normal range and having one end contacting the vehicle support means to move the boom through its entire normal range as the vehicle body moves with respect to the vehicle support means.

3. A toy vehicle supported on a play surface and having actuation of a part comprising:

(a) a vehicle body;

(b) means for supporting the vehicle with respect to the play surface and allowing generally vertical movement between the vehicle body and said means for supporting the vehicle body;

(c) resilient means exerting a force between the support means and the vehicle body to hold the vehicle body upwardly with respect to the vehicle support means and having a strength that is overcome by manually pushing the vehicle body toward the play surface;

(d) an actuated part mounted on the vehicle body and moveable through a normal range wherein the actuated part includes a vertically moveable member and a contacting horizontal member that engages the vehicle support means, to move the vertically moveable member through its entire range as the vehicle moves with respect to the vehicle support means.

* * * * *